United States Patent [19]

Albarda

[11] Patent Number: 4,722,675

[45] Date of Patent: Feb. 2, 1988

[54] PISTON PROPORTIONING PUMP

[75] Inventor: Scato Albarda, Gross Schenkenberg, Fed. Rep. of Germany

[73] Assignee: Drägerwerk Aktiengesellschaft, Fed. Rep. of Germany

[21] Appl. No.: 915,629

[22] Filed: Oct. 6, 1986

[30] Foreign Application Priority Data

Oct. 5, 1985 [DE] Fed. Rep. of Germany ..... 3535559

[51] Int. Cl.[4] ..... F04B 7/04; F04B 39/10

[52] U.S. Cl. ..... 417/509; 417/510

[58] Field of Search ..... 417/510, 479, 480, 469, 417/311

[56] References Cited

U.S. PATENT DOCUMENTS

| | | | |
|---|---|---|---|
| 1,756,678 | 4/1930 | Comming | 417/480 |
| 1,768,102 | 6/1930 | Beggen | 417/510 |
| 2,537,336 | 1/1951 | Ericson | 417/480 |
| 2,854,170 | 9/1958 | Borgardt et al. | 417/510 |
| 3,118,390 | 1/1964 | Kinsley | 417/510 |
| 3,362,335 | 1/1968 | Stephens | 417/311 |
| 3,868,048 | 2/1975 | Soodacter | 417/469 |
| 4,102,611 | 7/1978 | Broker | 417/469 |
| 4,261,690 | 4/1981 | Buescher | 417/510 |

FOREIGN PATENT DOCUMENTS

| | | | |
|---|---|---|---|
| 157895 | 7/1954 | Australia | 417/469 |

*Primary Examiner*—William L. Freeh

*Attorney, Agent, or Firm*—McGlew and Tuttle

[57] ABSTRACT

A piston proportioning pump for liquids, with a piston in a cylinder, an uptake and discharge valve and an oscillating drive is improved so that the formation of vapor bubbles or of a low pressure during the suction phase is prevented even when the pump space is filled quickly. The dead space of the piston proportioning pump still remains so small that a largely complete expulsion of the proportioned amount through the discharge valve is guaranteed. To this end, provisions are made so that the discharge communicates with the pump space within an uptake valve.

2 Claims, 2 Drawing Figures

PISTON PROPORTIONING PUMP

FIELD AND BACKGROUND OF THE INVENTION

This invention relates in general to pumps and in particular to a new and useful proportioning pump for liquids which includes a pump piston which is movable in an uptake valve cylinder which itself is movable and driven by a separate drive.

The invention concerns a proportioning pump for liquids including a piston in a cylinder, an uptake and discharge valve and oscillating drive. A similar piston proportioning pump is described in German OS No. 33 31 558. It is used to proportion smallest amounts of liquid or gaseous media accurately and reproducibly. It consists of a piston moving in a cylinder which exerts periodical suction and compression strokes driven by an oscillating drive, e.g. a crank mechanism. An uptake as well as a discharge valve open into the pump space.

The known proportioning pumps have the disadvantage that a drop in pressure occurs during the suction phase with opened uptake valve due to the resistance of the usually narow uptake valve, which results in the formation of vapor bubbles during the lifting of liquids with a high vapor pressure, or in incomplete filling in the pump space during the lifting of gaseous media. An exact proportioning is thereby made impossible. An expulsion of the formed vapor bubbles during the subsequent compression stroke, when the liquid is pressed out of the pump space through the discharge valve, is not guaranteed. The exact and reproducible proportioning of smallest amounts of liquid or gaseous media in the miroliter range requires the lowest possible flexibility of the pressure chamber and its contents including—no bubbles in the liquid which raise the compressibility dramatically—rigid pressure chamber walls—minimal flexibility of the valves themselves minimal dead space; so that the proportioned volume to be expelled can be moved in its entirety into the discharge line. Beyond this, more stringent demands must be made on the uptake as well as the discharge valve with respect to the prevention of leakages. With the known piston proportioning pump, the opening of the uptake valve during the occurrence of excess pressure in the feeding line and the escape of the medium to be proportioned throug the pump space and the discharge valve directly into the feeding line cannot be prevented. A proportioning is no longer possible in this case and an uncontrolled flow of medium to the user side occurs.

SUMMARY OF THE INVENTION

The present invention consequently has as its objective the improvement of a proportioning pump in such a way that even during fast filling of the pump space, the formation of vapor bubbles or the occurrence of low pressure is prevented during the suction phase and that the dead space volume of the piston proportioning pump still remains so small that largely complete expulsion of the proportional amount from the discharge valve is guaranteed.

In accordance with the invention, the discharge opens into a pump space within the uptake valve. The main advantages of the invention are seen in the fact that a flow free of dynamic compression losses can be established through the wide crosssection of the uptake valve into the pump space during the suction stroke. A formation of vapor bubbles during the uptake by suction by liquids with high vapor pressures, e.g. liquid narcotics, is largely prevented by this. Gaseous media are taken up by suction without any significant compression losses. Since practically no connecting line parts are located between uptake valve and pump space in a closed state, the dead space volume is small during the compression phase. In the open state, in contrast, the uptake valve forms an uptake zone with a large diameter, which completely surrounds the circumference of the pump space, so that the piston can execute a strong suction stroke for the filling of the pump space. The uptake valve is closed before the compression stroke starts.

Since the discharge opens into the pump space as well as within the uptake valve, the movable valve part of the uptake valve is formed to advantage by the cylinder in which the piston moves. The cylinder is moved by its own drive synchronously with the oscillating drive of the piston in such a manner that the uptake is connected with the pump space during the suction stroke and shortly before the beginning of the compression stroke, the cylinder is pressed against a seal surrounding the discharge, which makes the draining of the pump space through the discharge possible. An equivalent practical example could have the cylinder located stationary in the pump housing, while the valve housing is constructed as a movable part of the uptake valve and is controlled by the drive. But such a construction requires a greater expenditure for the sealing of the parts movable against each other.

The movable valve part can also be formed to advantage by a ring seal surrounding the discharge, which is pushed forward into the valve space so far by a control pressure that it lies against its seat. The arrangement of the controllable ring seal can be on the piston side or on the discharge side, as suitable. A simple construction consists of a ring membrane taken up in a ring groove, in which case the control pressure line is connected to the ring groove. The pressure is produced chronologically in the same synchronization adjusted to the piston movement, which was described for the movable cylinder. The compression producing medium may be in liquid or gaseous form. As the cylinder is moved, the residual stroke from the closing of the seal to a positive stop of the cylinder is added to the proportioned amount as additional stroke. The same applies accordingly with resting cylinder and expandable ring membrane. In order to eliminate this additional stroke, a combination of movable cylinder and controllable ring seal can be provided, where the activation of the ring seal occurs only when the cylinder has come to rest at the positive stop.

In an especially advantageous practical example, the cylinder moves coaxially to the piston and the cylinder gear is equipped with a flexible longitudinal compensation part. For a firm and defined closing of the pump space by the uptake valve, the cylinder is moved against the ring seal until it stops against the surface surrounding the ring seal, so that a piston seal equipped with a convex face surface can be inserted into the correspondingly concave entrance area of the discharge opening at the end of the compression stroke, to allow the complete emptying of the pump space. The possibly simultaneously present gas bubbles are pressed out of the pump space by this manipulation. To allow a firm stop for the cylinder stroke movement even at different longitudinal tolerances for the cylinder as well as for the driving mechanism of the cylinder stroke movement, the flexible longitudinal compensator takes over the equalization of such tolerances.

The discharge valve consists of a ball valve, to which a pretensioned disk valve is attached. The disk valve closes off the dead space volume formed by the discharge toward the disk valve, establishes an exact and reproducible delivery of the proportioned amount present in the pump space to the disk valve and brings about an extremely low flexibility of the pump space. The valve chamber of the ball valve is closed in the delivery direction by the pretensioned disk valve. A flexibility of the flat seal of the disk valve cannot affect the dead space because of the insertion of the ball valve. Should the disk valve fail to seal completely, a flowing back of the liquid present in the delivery line behind the disk valve is prevented by the ball valve when the uptake valve is open. Conversely, with a tight disk valve and a leaking ball valve, only the volume present between the two would flow back. The disk valve opens only when the proportioned amount delivered by the compression stroke of the piston overcomes the latter's closing pressure. Should an unwanted pressure build up in the feeding line to the uptake valve in the case of an error, such as may occur with inadequate ventilation or heating of the storage tank, for example, the closing pressure of the disk valve is adjusted so that with an open uptake valve is uncontrolled penetration of the medium through the proportioning pump cannot take place. The complementary design of convex piston face and concave feeding area permits a pushing out of vapor bubbles, should these enter the pump space. This may be the case, for example, when the storage tank for a liquid medium is pumped empty and air is then sucked in.

The zirconium oxide ceramic material proved to be especially advantageous for the construction of the cylinder, since it has better friction characteristics between the cylinder head gasket and bearing surface in the cylinder as well as the necessary external seals, than those exhibited by similarly suitable materials, e.g. hard metal, sapphire, aluminum oxide ceramic or amorphous glass graphite.

Accordingly it is an object of the invention to provide an improved piston pump in which the piston is movable in a pump cylinder which is also separately movably by a separate drive and in which the cylinder moves toward and away from a seal engagement with a pump space which communicates with a valve having a discharge passage.

A further object of the invention is to provide a proportioning pump which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
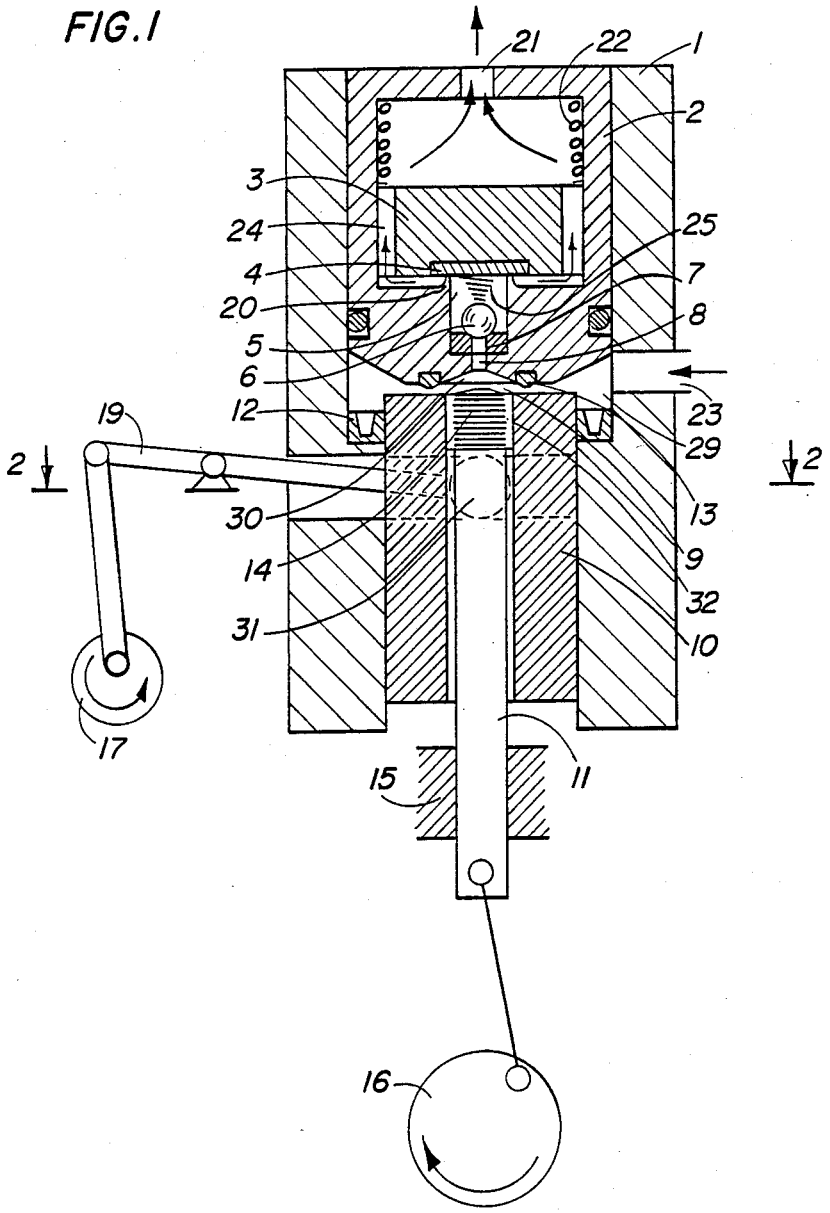
FIG. 1 is a sectional view of a piston proportioning pump constructed in accordance with the invention.

Referring to the drawings in particular, the invention embodied therein comprisese a proportioning pump for liquids which includes a pump housing 1 in which an uptake valve cylinder 10 is slidably movable toward and away from a valve chamber member 2 which has an end facing the cylinder with a concave feeding area 30 forming a pumped space 9 which is sealed during an operating stroke by engagement of the cylinder 10 with a ring gasket 13 so that liquid is forced through the discharge passage 8 to open a ball valve 6 which ultimately discharges through an opening 21.

In accordance with the invention the uptake valve cylinder 10 is movable in the housing 1 and is driven by a second drive means in the form of a crank 17 operating through a connecting linkage and a compensating balance 19. Piston 10 itself is driven by a first drive means in the form of an eccentric or crank 16 operating through a connecting linkage to move the piston 11 upwardly and downwardly in its associated uptake valve cylinder 10.

The piston proportioning pump shown in FIG. 1 consists of a pump housing 1, which contains valve chamber 2 and movable cylinder 10. Valve chamber 2 contains disk or cylinder valves 3 and 20 and ball valve 6 with a valve seat 7. Piston 11 is arranged movably in cylinder 10. Uptake 23 opens into an uptake chamber 29. Valve chamber 2 has a concave feeding area 30 and discharge passage 8 toward a pump space 9. The discharge is closed by ball 6 pressed onto its seat 7 by a conical spring 25. Valve space 5 of ball valves 6 and seat 7 is covered by a flat gasket 4 in the disk valve 3 along a sealing crater 20. Disk valve 3 is held by compression spring 22 and it is equipped with a guide ribs 24, between which draining channels are formed.

A piston drive 16 comprises a crank gear and it is used to produce oscillating suction and compression strokes of piston 11 along the inner surface of cylinder 10, against which it is sealed by piston gasket 14 at its head. This may comprise, for example, of polytetrafluoroethylene (PTFE) for the feeding of liquid narcotics. The beaker shaped piston gasket 14 is buttoned into a groove of piston 11 with an internal rib. On its outside, it has piston-ring-shaped sealing lips, which are attached to cylinder 10 by spring elements located between piston 11 and piston gasket 14. Piston gasket 14 has at its front surface 32 a convex form adapted to the concave feeding area 30. Piston bearing 15 guides the piston.

Cylinder 10 is located in pump housing 1 and is movable coaxially to piston 11 by its own cylinder gear 17 and the balance 19 and thus forms the movable valve part for the uptake valve 10. The seal of cylinder 10 opposite pump housing 1 accepts a labiate seal of PTFE, which has a U-shaped cross section. A spring element which presses the two lips against the surfaces to be sealed is embedded in the U-shaped opening.

The shown piston proportioning pump functions in the following way: In FIG. 1, the point in time is represented at which the medium in pump space 9 is pushed out completely through discharge 8 by the advanced piston 11 and subsequently cylinder 10 is lifted from its stop against ring seal 13 by cylinder gear 17 and thus uptake valve 10, 13 has been opened. Piston drive 16 prescribes half a rotation in one movement, through which the medium to be proportioned, e.g. liquid narcotic, is sucked through uptake 23 into the enlarging pump space 9. At the end of the suction stroke, cylinder 10 is moved against ring seal 13 until the front surface of cylinder 10 lies against the suface of valve housing 2 facing it. Uptake valve 10 is closed, and the compression stroke of piston 11 can begin. Depending on requirement and regulation of the piston drive 16, the contents of pump space 9 can be pushed out continuously in a complete compression stroke or in a series of partial steps, through a discharge 8, ball valve 6 and disk valve 3, via flow-off opening 21 to the user. As the upper dead center is reached, the front surface of piston seal 14 lies against feeding area 30. This completes one whole pump cycle.

Figure 2:
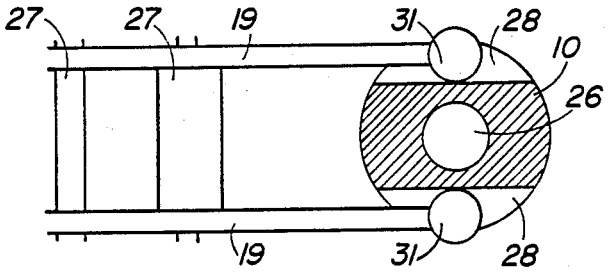
FIG. 2 is a schematic sectional view of the longitudinal compensation element taken along 2—2 of FIG. 1.

A practical example of the longitudinal compensating element 19 is shown in FIG. 2 with the cutaway 2—2 of FIG. 1. Here, only cylinder 10 with cylinder bore 26 is drawn, which has two slits 28 in transverse positions to its longitudinal axis. Spherical ends 31 of the balance formed by two rods 19 move in a sliding motion in these slits. Both rods 19 are connected by studs 27 at the joints of the balance. At the end of a cylinder stroke cylinder 10 lies firmly against the front side of valve housing 2. The remaining stroke of cylinder gear 17 is then absorbed as elastic bending of balance 19.

While a specific embodiment of the invention has been shown and described in detail to illustrate the application of the principles of the invention, it will be understood that the invention may be embodied otherwise without departing from such principles.

What is claimed is:

1. A proportioning pump for liquids, comprising a pump housing, a hollow movable uptake valve cylinder slidably mounted in said housing, said housing having a pump chamber aligned with said valve cylinder, a valve chamber member in said pump chamber sealed with said housing and having a pump discharge passage with an opening facing said valve cylinder and defining a pump space with said valve cylinder and a sealing face opposite to said valve cylinder, a valve in said discharge passage with a valve discharge, a piston movable in said valve cylinder to pump liquid through said valve cylinder to said discharge, first drive means connected to said piston to reciprocate said piston into and out of engagement with said sealing face, said sealing face including a ring gasket, said valve chamber member being displaceable toward and away from valve cylinder for controlling the pressure generated by said pump, and second drive means connected to said valve cylinder to move it into and out of engagement with said ring gasket, said valve chamber member having a ball valve and a connecting pre-tensioned disk valve in said discharge passage.

2. A proportioning pump for liquids, comprising a pump housing, a hollow movable uptake valve cylinder slidably mounted in said housing, said housing having a pump chamber aligned with said valve cylinder, a valve chamber member in said pump chamber sealed with said housing and having a pump discharge passage with an opening facing said valve cylinder and defining a pump space with said valve cylinder and a sealing facing opposite to said valve cylinder, a valve in said discharge passage with valve discharge, a piston movable in said valve cylinder to pump liquid through said valve cylinder to said discharge, first drive means connected to said piston to reciprocate said piston into and out of engagement with said sealing face, said sealing face including ring gasket, said valve chamber member being displaceable toward and away from valve cylinder for controlling the pressure generator by said pump, and second drive means connected to said valve cylinder to move it into and out of engagement with said ring gasket, said piston having a convex end facing said valve chamber member and said valve chamber member having a convex shape facing said piston.

* * * * *